US005245921A

United States Patent [19]

Helinski et al.

[11] Patent Number: 5,245,921

[45] Date of Patent: Sep. 21, 1993

[54] INTERPOSER DEVICE FOR IMPACT PRINTERS

[75] Inventors: Edward F. Helinski, Johnson City; Larry T. Sehringer, Vestal, both of N.Y.

[73] Assignee: International Business Machines Corporation, Armonk, N.Y.

[21] Appl. No.: 914,972

[22] Filed: Jul. 16, 1992

[51] Int. Cl.[5] ..... B41J 1/20

[52] U.S. Cl. ..... 101/93.14; 400/146

[58] Field of Search ..... 101/93.13, 93.14, 93.31, 101/93.32; 400/144, 146, 248, 642

[56] References Cited

U.S. PATENT DOCUMENTS

| | | | |
|---|---|---|---|
| 3,848,722 | 11/1974 | Bolan et al. | 400/157.2 |
| 3,890,895 | 6/1975 | Deproux | 101/93.14 |
| 4,579,055 | 4/1986 | Thorne | 101/93.14 |
| 4,780,015 | 10/1988 | Anderson et al. | 101/93.14 |
| 4,967,662 | 11/1990 | Clark et al. | 101/93.14 |

OTHER PUBLICATIONS

IBM Technical Disclosure Bulletin "Impact Line Printer For All Point Printing", vol. 33 No. 1A Jun. 1990, pp. 433–434.

IBM Technical Disclosure Bulletin "Print Hammer Protection and Vibration Reduction on Dot Band Printer", vol. 31 No. 5, Oct. 1988, pp. 223–224.

*Primary Examiner*—Edgar S. Burr
*Assistant Examiner*—Stephen R. Funk
*Attorney, Agent, or Firm*—Michael E. Belk

[57] ABSTRACT

An interposer device for use in an impact printer for printing at condensed pitches includes an interposer plate and a striker strip attached thereto. The interposer plate is a thin spring steel plate slotted to have a plurality of chevron flexure elements symmetrically disposed across the plate. The striker strip is a thin strip of elastomeric material which is similarly slotted to have a plurality of chevron wear prevention flexure elements. Tabs on the edges of the striker strip and pockets on the surface of the interposer plate which receive the tabs provide for removably attaching the strip to the plate whereby the chevron wear flexure elements of the strip overlay the chevron flexure elements of the plate for joint deflection by impact.

9 Claims, 2 Drawing Sheets

INTERPOSER DEVICE FOR IMPACT PRINTERS

FIELD OF THE INVENTION

The invention relates to printing and particularly to an interposer device for use in impact printers for printing at different print densities.

RELATED APPLICATIONS

1. Application of E. F. Helinski entitled "Printer Apparatus For Printing At Different Print Densities", Ser. No. 07/915,445 filed concurrently herewith.

2. Application of E. F. Helinski entitled "Interposer Device And Striker Strip Therefor", Ser. No. 07/914,970 filed concurrently herewith.

BACKGROUND OF THE INVENTION

In the related applications, there is shown an interposer device comprising a metallic interposer plate with flexure elements designed to be impacted by print hammers to effect printing at condensed pitches. A wear prevention means comprises a polymer striker strip attached to the side of the interposer plate which faces the print hammers. In the second related application, a polymer striker strip is provided which has improved compliance and is part of an assembly which is more easily handled and attached to the interposer plate having chevron flexure elements. Notwithstanding the advantage of the improved striker strip and assembly in the related application, it was considered desirable to provide an interposer device having a striker strip which further improved the wearability, a more efficient transfer of energy and which is easy to handle and assemble onto the interposer plate.

SUMMARY OF THE INVENTION

The invention achieves this by providing an interposer device in which the interposer plate and the striker strip are both slotted so that the interposer plate has a plurality of chevron flexure elements disposed symmetrically along the plate and the wear strip has a plurality of chevron wear flexure elements disposed symmetrically along the wear strip. Preferably the chevron wear prevention elements are designed to be substantially the same in size, spacing and shape as the chevron flexure elements of the interposer plate. Attachment means is provided on the striker strip and interposer plate for attaching the striker strip on one surface of the interposer plate in a manner whereby the wear flexure elements of the striker strip overlay and are individually overlayed by the flexure elements of the interposer plate. In the preferred embodiment of the invention, the attachment means takes the form of tab elements arranged along the edges of the striker strip and pocket means on the surface of the interposer plate correspondingly arranged for receiving and removably retaining the tabs therein. Preferably the interposer plate is a thin plate made of metal such as spring or stainless steel and the interposer plate is a thin flexible strip of elastomeric material such polyethylene teraphthalate, and particularly a polyimide such as Kapton® polimide by duPont. Using such materials, considerably longer wear is realizable. Better energy transfer is obtained due to the fact that both the flexure elements of the interposer plate and the striker strip are deflectable jointly without stress in opposition to the impact of the print hammers. The tab and pocket structure of the attachment means enables the striker strip to be mounted onto the interposer plate.

The foregoing and other features and advantages of the invention will be more readily apparent from the following more particular description of a preferred embodiment of the invention as illustrated in the accompanying drawings.

DETAILED DESCRIPTION OF THE INVENTION

Figure 1:
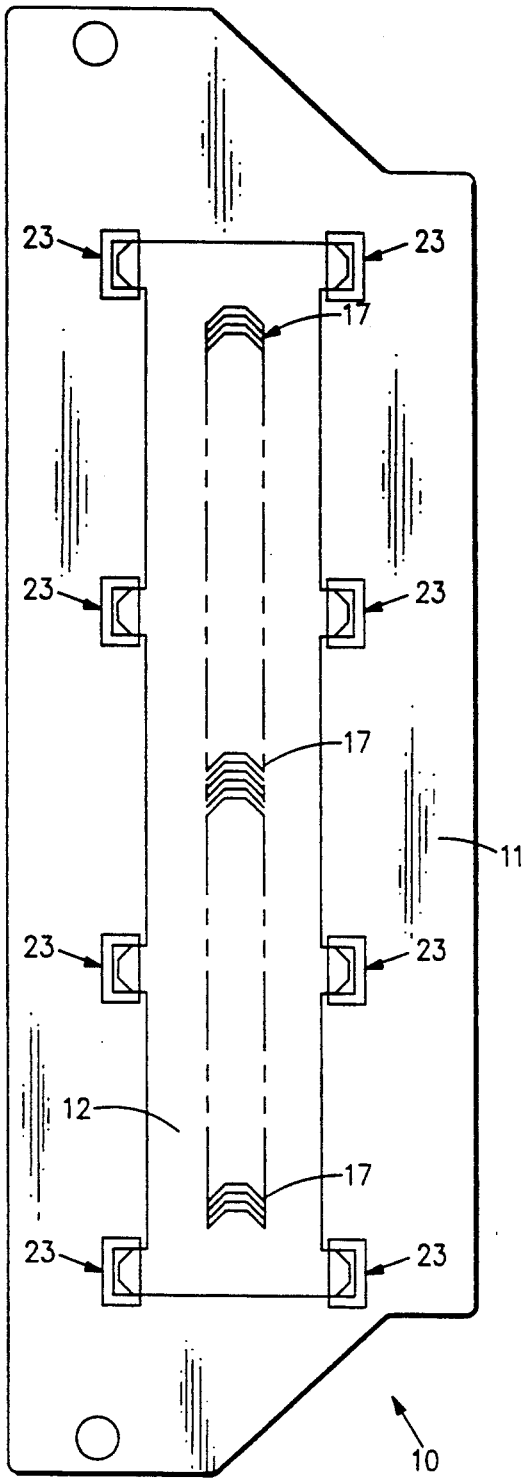
FIG. 1 is a plan view of the interposer device incorporating the invention.
Figure 2:
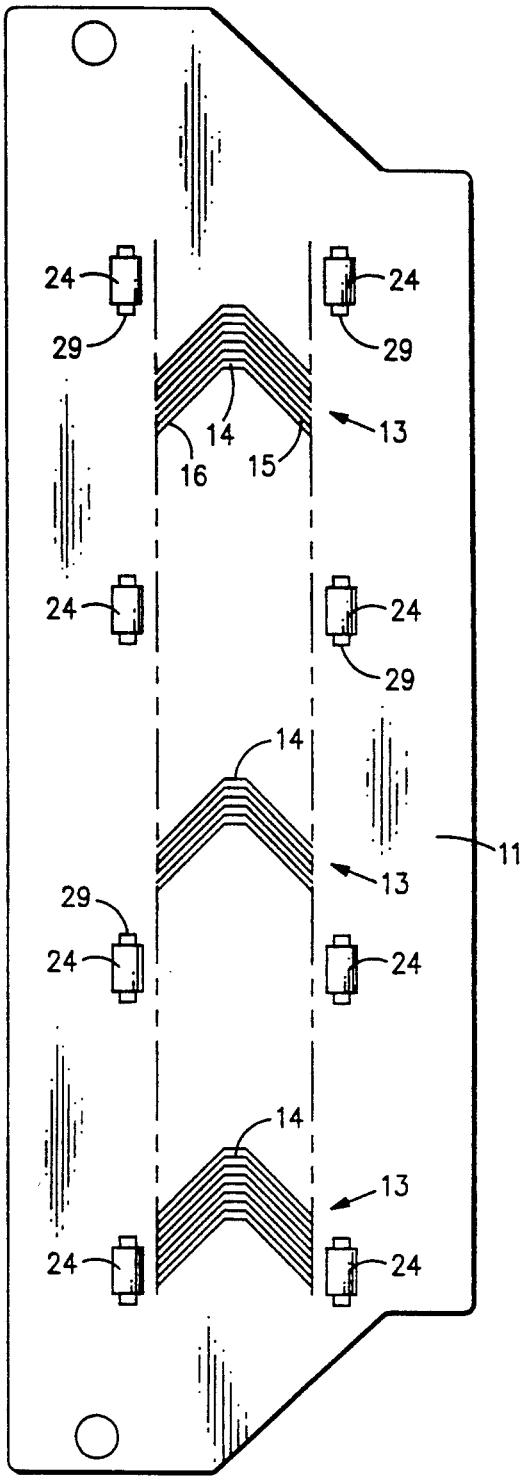
FIG. 2 is a plan view of the interposer plate portion of the interposer device of FIG. 1.

Referring to FIG. 1, an interposer device 10 for use in an impact line printer for printing at condensed pitches comprises interposer plate member 11 and striker strip element 12 mounted thereon. As shown more clearly in FIG. 2, interposer plate 11 has a plurality of chevron flexure elements 13 symmetrically disposed across plate 11. Each flexure element 13 has an apex section 14 connected by acutely angled flexure arms 15 and 16 to the margins of plate 11. Apexes 14 are of the same size and width and are uniformly spaced in a longitudinal row extending across plate 11 as described in further detail in the above mentioned related application number 1.

Figure 3:
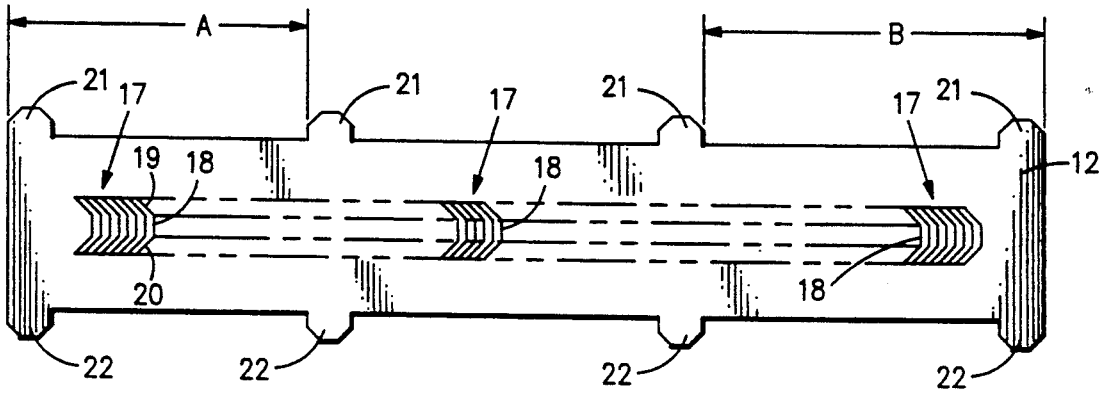
FIG. 3 is a plan view of the striker strip portion of the interposer device of FIG. 1.

As seen in FIG. 3, striker strip 12 is slotted to have a plurality of chevron wear flexure elements 17 with apex sections 18 and with flexure arms 19 and 20 connected to the margins of the strip. Flexure arms 19 and 20 preferably are shorter than flexure arms 15 and 16, otherwise chevron wear flexure elements have the same size, shape and dimension (except for thickness) as the flexure elements 13 of interposer plate 11 and the apex sections 18 are arranged in a like longitudinal row across the striker strip 12.

Figure 4:
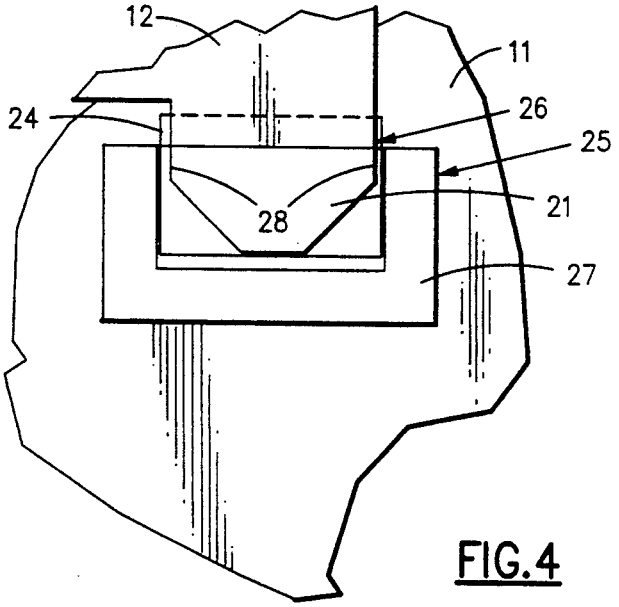
FIG. 4 is a enlargement of a part of the interposer device of FIG. 1.

The edges of striker strip 12 are formed with tabs 21 and 22. Striker strip 12 is attached to interposer plate 11 by slipping tabs 21 and 22 into pockets 23 on the surface of plate 11. As seen more clearly in FIG. 4, pockets 23 are comprised of two sets of rectangular recesses 24 on either side of flexure elements 13 and cover elements 25 which partially cover recesses 24 leaving an opening 26 for the reception of tabs 21 and 22. The cover elements 25 have a U-shaped pressure sensitive adhesive tape 27 around three of it's four sides. The untaped side is aligned with the fourth end of pockets 23 to provide opening 26 for accepting the tabs 21 and 22 which each have three locating edges 28 which coact with edges of recesses 24 for locating striker strip 12. Location lines 29 (see FIG. 2) near recesses 24 enable cover elements 25 to be properly located so that the adhesive tapes do not overlap the edges of recesses 24. Striker strip 12 is located on interposer plate 11 and is aligned such that the chevron wear flexure elements 17 overlay and are in substantial alignment thus allowing free and unrestricted movement of the interposer element when acted on by print hammers of an impact line printer printing condensed pitches. Thus the energy transfer is more efficient. The tabs 21 and pockets 23 are arranged in pairs. The pairs are located opposite one another which provides stable retention of the striker strip 12.

Correct insertion of the tabs 21 and 22 is ensured because dimension A is not equal to dimension B.

Tabs 21 and 22 are accurately located on the edges of striker strip 12. Similarly recesses 24 are accurately located to obtain precise alignment. The depth of recesses 24 and thickness of tabs 21 and 22 are such that a small clearance will always be provided between tabs 21 and 22 and pockets 23. Preferably interposer plate 11 is made of a thin metal plate such as spring steel having a thickness in the range of 0.006 to 0.010 inches and recesses 24 are formed by etching to a depth of about 0.006 inches. Striker strip 12 can be a thin strip or sheet of elastomeric material such as polyethlene teraphthalate and is preferably a polyimide such as Kapton® film made by duPont having a thickness in the range of 0.003 to 0.005 inches. A suitable material for cover elements 25 comprises a polyester material, such as MYLAR TM polyester made by duPont, with a thickness of 0.005 inches. Striker strip can be made by both etching and die cutting. Mounting of striker strip 12 onto plate 11 is obtained simply by placing tabs 21 into the openings 26 of one set of pockets 23 and then slightly curling strip 12 along its longitudinal axis and inserting the tabs 22 into openings 26 of the other set of pockets 23. Releasing strip 12 allows it to uncurl due to its resilience so that tabs 22 are pressed through openings 26 into pockets 23. Tabs 21 and 22 are made sufficiently long so that any bending thereof by the edge of recesses 24 is localized away from the edges of strip 12 and does not cause substantial lifting of strip 12 away from the surface of interposer plate 11. Apex sections 18 of strip 12 are thereby located directly over apex sections 14 of flexure elements 13 for free and unrestricted deflection therewith.

While the invention has been particularly shown and described with reference to a preferred embodiment thereof, it will be understood by those skilled in the art that various changes in form and detail may be made therein without departing from the spirit and scope of the invention.

What is claimed is:

1. An interposer device for an impact printer comprising in combination an interposer plate member slotted to have a plurality of chevron flexure elements symmetrically disposed across said plate, a striker strip member slotted to have a plurality of chevron shaped wear prevention flexure elements similarly symmetrically disposed across said striker strip, and attachment means for removably attaching said striker strip member to said interposer plate in a manner whereby said wear prevention flexure elements overlay flexure elements of said interposer plate.

2. An interposer device for use in an impact printer in accordance with claim 1 in which said attachment means comprises tab means arranged along opposite edges of said striker strip member, and pocket means arranged on a surface of said interposer plate on opposite sides of said flexure elements of said interposer plate for receiving and removably retaining therein said tab means of said striker strip member.

3. An interposer device for use in an impact printer in accordance with claim 2 in which said pocket means comprise recessed in the surface of said interposer plate, and cover elements covering a portion of said recesses so that one end is open to receive said tab means of said striker strip.

4. An interposer device for use in an impact printer in accordance with claim 1 in which said interposer plate member is a thin plate of spring steel slotted to form said chevron flexure elements therein, and said striker strip member is a thin sheet of elastomeric material slotted to form said chevron flexure wear elements therein.

5. An interposer device for use in an impact printer in accordance with claim 4 in which said striker strip member is a thin sheet of polyethlene teraphthalate.

6. An interposer device for use in an impact printer in accordance with claim 4 in which said striker strip member is a thin sheet of polyimide.

7. An interposer device for use in an impact printer in accordance with claim 4 in which said interposer plate has a thickness in the range of 0.006 to 0.010 inches, and said striker strip has a thickness in the range of 0.003 to 0.005 inches.

8. An interposer device for an impact printer in accordance with claim 1 in which said plurality of said chevron wear prevention flexure elements of said striker strip member is equal in number to said plurality of chevron flexure elements of said interposer plate, and said attachment means removably attaches said striker strip member to said interposer plate in a manner whereby said wear prevention flexure elements of said striker strip overlay and are individually aligned with corresponding flexure elements of said interposer plate.

9. An interposer member for use with a striker strip element to form an interposer device usable in an impact printer, comprising a plate member slotted to form a plurality of chevron flexure elements symmetrically disposed across said plate, said flexure elements having apexes arranged in a row longitudinally across said plate, and pocket means formed in a surface of said plate member on either side of said flexure elements for removably retaining a striker strip element in protective alignment with said apex sections of said flexure elements.

* * * * *